United States Patent [19]

Heine et al.

[11] Patent Number: 4,802,525

[45] Date of Patent: Feb. 7, 1989

[54] REMOVING A CASTING FROM A MOLD

[75] Inventors: Gerold Heine, Uhldingen-Muehlhofen; Joachim Stark, Friedrichshafen, both of Fed. Rep. of Germany

[73] Assignee: Dornier Medizintechnik GmbH, Germering, Fed. Rep. of Germany

[21] Appl. No.: 938,571

[22] Filed: Dec. 5, 1986

[30] Foreign Application Priority Data

Dec. 5, 1985 [DE] Fed. Rep. of Germany ..... 3543062

[51] Int. Cl.[4] ..... B22D 29/00

[52] U.S. Cl. ..... 164/48; 164/131; 164/132; 164/510

[58] Field of Search ..... 164/48, 131, 132, 250.1, 164/501, 510, 511, 404

[56] References Cited

FOREIGN PATENT DOCUMENTS 0234811 4/1986 Fed. Rep. of Germany ..... 164/132

0440862 3/1978 U.S.S.R. ..... 164/404

*Primary Examiner*—M. Jordan

*Assistant Examiner*—Richard R. Seidel

*Attorney, Agent, or Firm*—Ralf H. Siegemund

[57] ABSTRACT

A mold or parts of the mold are removed from a casting following solidification and cooling by immersing the casting with mold or mold particles still attached in a liquid such as oil or water and focusing shock waves onto interface portions to obtain ablation and spalling of the mold material to be removed from the casting.

4 Claims, 1 Drawing Sheet

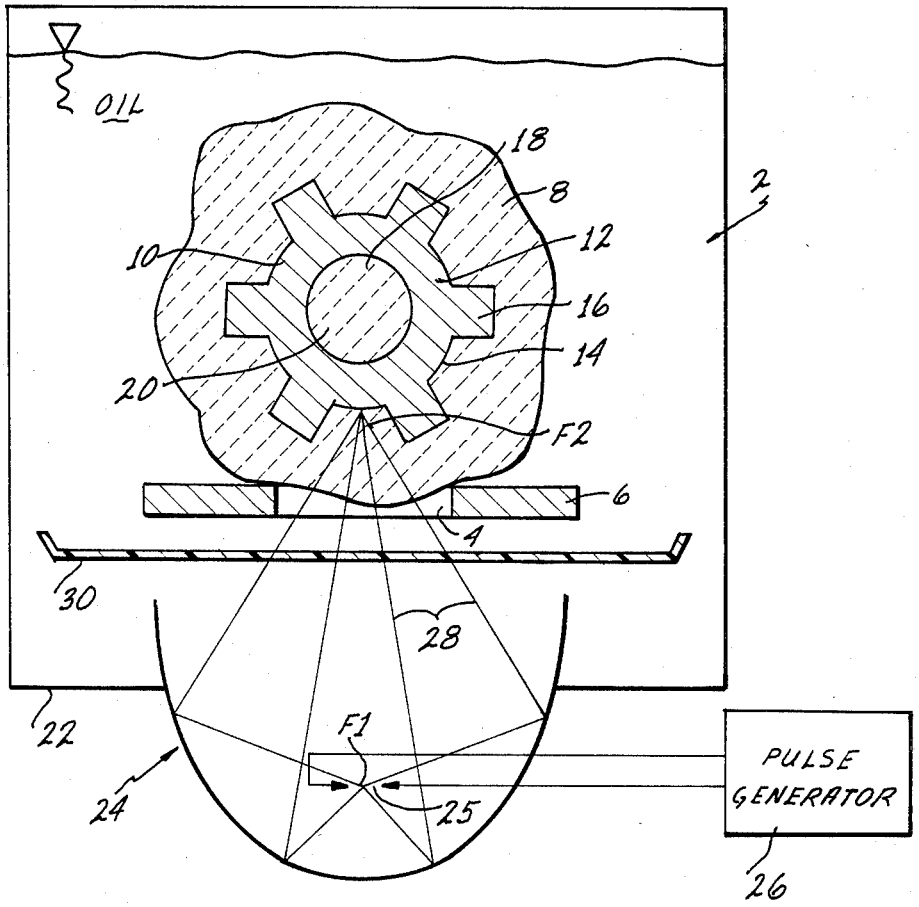
OIL
18
8
2
10
12
16
14
20
F2
6
4
30
28
22
F1
PULSE
GENERATOR
24
25
26

REMOVING A CASTING FROM A MOLD

BACKGROUND OF THE INVENTION

The present invention relates to the removal of molds, central and/or peripheral mold parts from a casting.

The shaping of parts by means of molds and forming of metal castings by means of molds is a technique of long (even ambient) standing. Herein the liquified material such as molten metal is poured into a mold being so to speak a negative of the contour of the part to be made. Subsequently the molten metal is permitted to solidify in the mold. Such a mold is usually made of ceramic material. Following the solidification and cooling the mold is simply broken off in one form or another and the casting part is cleaned by means of water jets, sand blasting, chemically or otherwise so as to obtain complete removal of any mold material parts or particles from the casting.

If the shape of the casting is of a simple nature the mold removal process is commensurately simple. However, in the case of a complex contour, particularly where the casting has corners, pocketlike contours, indents or the like, the possibility cannot be excluded that certain parts of the mold still remain with the casting. This in turn may detrimentally affect the use life of the cast product.

A number of methods and devices for removing molds or mold parts or cores from a casting are known, for example through the German printed patent application No. 19 62 182; the German journal Giessereitechnik, Vol. 29, 1983, issue 3, pages 205–210 or pages 239–244; also a book known under the name "Giesserei-Lexikon", 1983, page 859 refers to such methods and equipment. Particularly these methods involve removal of mold parts from the casting through arc discharge or explosion producing shock waves or ultrasonic waves may be used for that removal.

These methods of the prior art are on the other hand usable only when the parts i.e. the castings are still relatively simple. It is still not guaranteed that mold parts which lodge in indents, bores, undercut portions or the like will in fact be removed so that the problem mentioned above, namely the reduction in use life of the casting on account of residual mold parts is still not solved.

DESCRIPTION OF THE INVENTION

It is an object of the present invention to provide a new and improved method and equipment for positively removed mold and core parts from a casting even if the casting has a complex contour and shape.

In accordance with the preferred embodiment of the present invention, it is suggested to direct and orient focused shock waves upon mold parts to be removed from a casting with particular effectiveness concentrated on the interface so as to make maximum use of acoustic discontinuities as between a mold part or particle and the dissimilar casting itself. This focusing action with the resulting high rate variation in the stress-strain action right in the interface will cause spalling and ablation of the mold part or particle and will in fact cause complete removal from the casting whereby in principle as well as in reality no limitation exists concerning accessibility of the part or particle to be removed in relation to a complex contour of the casting.

The invention takes advantage of the fact that particularly brittle materials (and a ceramic mold is brittle) can be fragmentized and comminuted into small parts down to the point of grit or dust which is then easily removable. A work piece can in this manner be completely cleaned from any remainder of the mold including of course any central core part. Since the casting itself is made of metal its resistance against fracture upon pressure and tension is considerably higher than the comparable property of the mold. For this reason the casting itself is not going to be damaged in any manner whatsoever by the cleaning process using focused shock waves.

The surface finish and other related properties of the casting and particularly accuracy of its dimensions will not be interfered with at all by the focused shock wave. This is an important feature since precision casting often requires a high degree of accuracy of the part that is being made. This aspect is in contradistinction to mechanical working such as scraping of the work piece to remove mold residue since very easily the surface can be scratched and, therefore, the accuracy of the casting as far as its dimensions are concerned may be interfered with. Thus, an application of the inventive method is particularly suitable in case of precision casting. Of course other castings such as coarse castings can also be improved by the invention but that may not be necessary since simple scraping and other mechanical removal of mold residue may not be disadvantaged because for the working of a coarse casting of billets etc. and surface quality or accuracy is not important. It is a significant aspect of the invention that focused shock waves are capable of removing mold material, in a general sense, in a very careful fashion which does not attack the surface of the casting or the casting as such.

The casting plus mold should be immersed in a liquid such as oil or water in order to better control the focusing of the shock wave. Generally the shock wave generating and focusing device can be assumed to be stationary and structure is provided to move the relative surface parts of the casting past the focal point of that shock wave generator, inside the liquid bath, so as to cover the entire surface or at least critical parts of the surface of the casting with regard to removal of mold parts or particles. Generally speaking the casting part with all or some of the mold still attached may be cardan mounted on a table that is movable in three dimensions inside a water tank. Through computer control the part is turned and shifted to cover the entire surface and to have the focused beam work on all parts of the surfaces of the casting. The acoustic impedance of the bath into which the casting is immersed should match as much as possible the acoustic impedance of the mold material which is enhanced if the mold is in fact porous and water can penetrate deeply into the mold material.

DESCRIPTION OF THE DRAWINGS

While the specification concludes with claims particularly pointing out and distinctly claiming the subject matter which is regarded as the invention, it is believed that the invention, the objects and features thereof will be better understood from the following description taken in connection with the accompanying drawings in which:

The FIGURE illustrates somewhat schematically a device and equipment for practicing the preferred embodiment of the present invention in accordance with the best mode thereof. In particular a cross section is shown through equipment for treating castings still embedded in a mold, by means of shock waves.

A tub 2 filled with oil is provided and a table 6 with a cutout is situated inside that tank or tub. A mold 8 sits on table 6 which mold is assumed to contain or embed a casting 10. The casting is a sleeve 14 with longitudinal ribs 16 projecting radially from the sleeve proper. The casting is to be hollow having a bore 18 accordingly and a mold core 20 is contained in that bore. All parts of the casting 8 as well as the core 20 have to be removed.

The tub or tank 2 has a bottom 22 in which is inserted a reflector 24 constructed as a portion of a rotational ellipsoid. Such an ellipsoid has two focal points $F_1$ and $F_2$. A spark gap 25 is arranged in the focal point $F_1$ i.e. two electrodes are positioned very close to the focal point $F_1$. These electrodes are connected to a pulse generator 26 which provides electrical pulses to the electrodes such that arcing occurs. Reflector 24 and spark gap 25 together constitute a curved transducer.

Since the interior of the ellipsoid is also filled with a liquid that is contained in the tube 2 a shock wave is introduced in that liquid whenever a spark is triggered. The shock wave may last about 500 ns, possibly not more than 1 microsec. The shock wave follows a path as indicated by propagation path lines 28 and owing to the particular contour of the reflector the shock waves that reach the reflector wall will be focused into $F_2$; the focal concentration of the shock waves will cause the generation of pressure peaks in $F_2$ in the order to 1000 to 2000 bar.

The table 6 is positioned so that the focal point $F_2$ does occur in a interface portion of mold material 8 and casting. The shock waves are focued in that fashion on such an interface point such that the mold material breaks off and is therefore removed from the surface of casting 10. The shock waves are triggered in a particular sequence and in between two pulses the mold 8 is moved to cover the entire surface of the casting so that all mold residue can be removed and will be removed. The same is true with regard to the core 20 which will basically be pulverized and will fall out of the core.

Reference numeral 30 denotes schematically a tray onto which the broken off mold parts will fall for early removal. If made of a synthetic, its acoustic properties can be closely matched to those of oil so that little scattering occurs of the shock waves. The casting 10 will lodge on the table 6 after the lower mold parts have been removed. Once in a stable position the casting will not move any more on the table. As the rest of the mold is removed, the table will be moved three dimensionally so that the focal point $F_2$ sweeps and scans over the entire surface of the casting 10.

Depending on the circumstances one can readily make sure that the surface of the casting is completely clean. For example the corners between ribs 16 and sleeve 14 may be focussed on by shock waves several times. The same is advisable for the edges of the ribs. Generally speaking "inaccessible" portion should receive more than one shock wave pulses. The areal clearing is a matter of resolution of the system depending on one hand by the moving speed of the embedded casting and of the frequency or pulse rate for the shock wave. As stated a liquid is contained in the tank 2 and the purpose of the cut out 4 is to expose the mold material directly to the beam of focused shock waves. The acoustic impedance is always given by the product of density and sound propagation speed and if the impedance of the liquid and of the mold 8 after the more effective will the focusing be. It was found that oil is highly suitable as tank medium but ordinary water will suffice in many cases.

The invention is not limited to the embodiments described above but all changes and modifications thereof, not constituting departures from the spirit and scope of the invention are intended to be included.

We claim:

1. Method for removing the mold or parts of the mold from a casting following solidification and cooling comprising the steps of immersing the casting with mold or mold particles still attached in a liquid; and generating and focusing shock waves by means of a curved transducer onto interface portions between the mold and mold parts on one hand and the casting on the other hand, to obtain ablation and spalling of the mold material to be removed from the casting.

2. Method as in claim 1 including the step of moving the casting with mold part or particle past the focal point of shock wave generation.

3. Method as in claim 1 and including the step of focusing on edges and corners several times.

4. Method as in claim 1 including the step of generating the shock waves through spark gap generation, the focusing being obtained through a rotational ellipsoid portion of the curved transducer.

* * * * *